United States Patent [19]

Skomal

[11] 4,357,611

[45] Nov. 2, 1982

[54] RADAR CROSS SECTION AUGMENTATION

[75] Inventor: Edward N. Skomal, Redlands, Calif.

[73] Assignee: The United States of America as represented by the Secretary of the Air Force, Washington, D.C.

[21] Appl. No.: 676,442

[22] Filed: Apr. 15, 1976

[51] Int. Cl.[3] ..... H01Q 15/18

[52] U.S. Cl. ..... 343/18 C; 343/18 E

[58] Field of Search ..... 343/18 C, 18 E

[56] References Cited

U.S. PATENT DOCUMENTS

| | | | |
|---|---|---|---|
| 3,126,544 | 3/1964 | Greatbatch, Jr. | 343/18 C X |
| 3,230,531 | 1/1966 | Bischoff et al. | 343/18 C X |
| 3,283,324 | 11/1966 | Norman, Jr. | 343/18 E X |
| 3,792,477 | 2/1974 | Tomiyasu | 343/18 C X |

*Primary Examiner*—T. H. Tubbesing

*Attorney, Agent, or Firm*—Donald J. Singer; Frank J. Lamattina

[57] ABSTRACT

Structural improvement for, and method of, achieving radar cross section augmentation of a conical reentry space vehicle decoy having a dielectric heatshield by structuring the base of the decoy to meet certain conditions. Augmentation is achieved by structuring the decoy to have at the base a reflecting step with a 90 degree angle formed by the internal surface of heatshield and the surface of the base portion of the heatshield, where the dielectric constant of the heatshield is in a range of values predetermined by use of the equation: $\epsilon \geqq 2(1+\tan\alpha)+\tan^2\alpha$, where $\epsilon$=the dielectric constant of the heatshield, and $\alpha$=the half angle cone of the conical decoy. Any incident radar signal impinging in a nose-on direction upon the external surface of the heatshield enters the heatshield, is completely double reflected within the reflecting step of the heatshield, and is re-directed out of the heatshield and in the opposite direction (i.e., in the direction of the nose of the decoy). The forward (i.e., nose-on) radar cross section of the decoy is thereby significantly augmented, without the appendages, external of the decoy, that are required by the prior art.

3 Claims, 3 Drawing Figures

RADAR CROSS SECTION AUGMENTATION

STATEMENT OF GOVERNMENT INTEREST

The invention described herein may be manufactured and used by or for the Government for governmental purposes without the payment of any royalty thereon.

BACKGROUND OF THE INVENTION

This invention relates to radar and, more particularly, radar cross section (hereinafter referred to as "RCS") augmentation of a radar signal reflected from a conical reentry space vehicle (hereinafter referred to as a "reentry vehicle") used as a decoy to simulate a much larger reentry vehicle, and thereby deceive, in the national interest, and hostile tracker thereof.

It is to be understood that the term "reentry vehicle", as used herein, is intended to mean a space vehicle (or decoy thereof) which is not only capable of being launched or the like into space, but which is also capable of successfully reentering the earth's atmosphere.

It is well known that booster loading, ejection mechanism and packaging constraints favor small diameter decoys. However, conical reentry vehicle decoys have RCS which decrease with, and as compared to, their base diameter. Thus, reentry vehicle RCS matching requirements favor large base diameter decoys to achieve moderate RCS levels (i.e., o to −25 dBsm, UHF through C-Band). Consequently, mechanical and electrical constraints are in opposition. This fact motivates search for ways to achieve large forward RCS levels for small decoys. Among the known passive means for increasing small conical body RCS is attachment of unfurlable scattering structures to the decoy which erect after or upon decoy release. Other means include modifications of the decoy body to increase the forward RCS. The present invention lies in the second catagory, providing a structural improvement for, and a method of, small decoy reentry vehicle RCS enhancement without the use of unfurlable attachments.

More specifically, I have invented an improvement, and a method, each of which yields a large forward RCS, for a decoy of a conical reentry space vehicle having a small base, over a broad range (i.e., more than two octaves), without either the use of any unfurlable appendage, or the on-board amplification of an illuminating signal. I have, thereby, significantly advanced the state-of-the-art.

SUMMARY OF THE INVENTION

This invention relates to a structural improvement for, and a method of, increasing the forward RCS of a conical reentry space vehicle without using appendages and the like external of the reentry vehicle.

An object of this invention, therefore, is to teach this structural improvement.

Another object of this invention is to teach the steps of this method.

These objects, and still other related objects, of this invention will become readily apparent, after a consideration of the description of the inventive structural improvement and method, and after reference to the Figures of the drawings.

DESCRIPTION OF THE PREFERRED EMBODIMENT OF THE IMPROVEMENT

Figure 1:
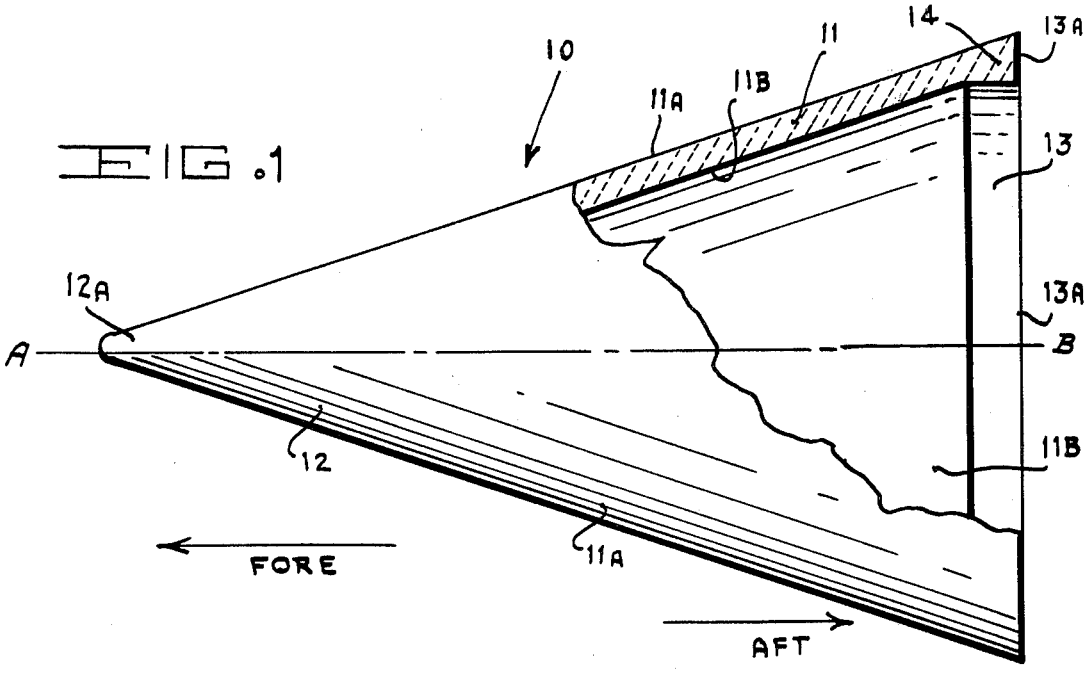
FIG. 1 is a side elevation view, partially in cross section, partially fragmented, and in simplified form of a typical small-based reentry space vehicle.

With reference to FIG. 1, therein is a typical small-based conical reentry space vehicle 10 having a geometric axis A-B, a dielectric heatshield 11 with an external surface 11A, an internal surface 11B, a forward portion 12 with a nose 12A, and a base portion 13 with a surface 13A.

The reentry vehicle 10 has (or, more accurately, "forms") a radar cross section, and has a dielectric preselected or predetermined dielectric constant which will be discussed later herein.

The preferred embodiment of the improvement comprises, in essence, a reflecting step 14 at the base portion 13 of the heatshield (and reentry vehicle 10) which has certain characteristics that will be discussed later herein.

Also shown in FIG. 1 are the directional designations "Fore" and "Aft" with corresponding arrows.

Figure 2:
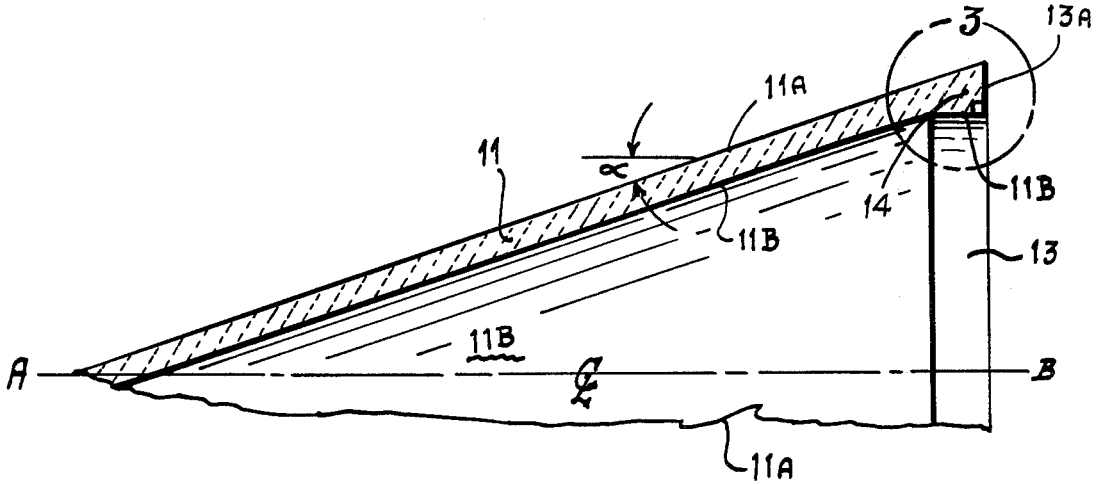
FIG. 2 is a side elevation view, also partially in cross section, and partially fragmented, and in simplified form of a portion of the reentry vehicle shown in FIG. 1.

With reference to FIG. 2, therein is shown a pertinent portion of the reentry vehicle 10 shown in FIG. 1, wherein the axis and each surface, portion, and the like has the same reference letter number or letter assigned to it in FIG. 1.

Readily seen is the half cone angle $\alpha$ of the conical reentry space vehicle 10. Also seen is base step angle $\phi$ which is formed by and at the intersection of the internal surface 11B of the heatshield 11, and the surface 13A of the base portion 13 of the heatshield 10.

A portion of the reentry vehicle having the reflecting step 14 and the base step angle $\phi$ has been encircled by circular line 3 for identification and ease in locating.

Figure 3:
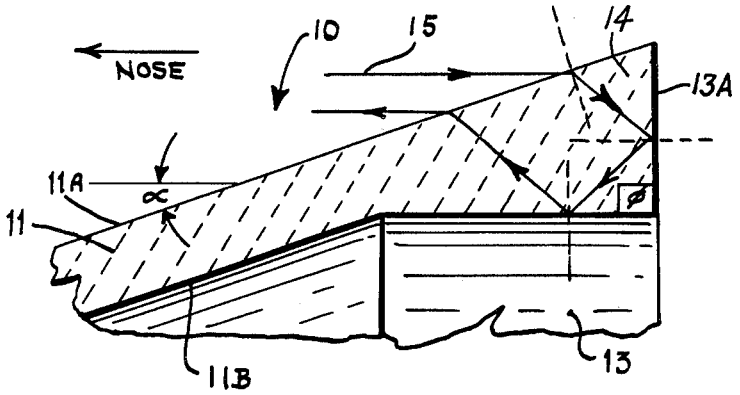
FIG. 3 is a side elevation view taken along circular line 3, enlarged and in detail.

Said portion is shown in FIG. 3, enlarged and in detail, and with reference to FIG. 3 therein is shown a representative radar signal incident ray 15 that is impinging on the external surface 11A of dielectric heatshield 11 of reentry vehicle 10 from a nose-on attitude and direction. The ray 15 is shown thereafter entering the dielectric heatshield 10 and being totally reflected twice within the reflecting step 14, and then emerging outward of the heatshield 11 in the direction of the nose, with said direction indicated by an arrow and a legend.

DESCRIPTION OF THE INVENTIVE METHOD

With regard to my inventive method for augmenting the radar cross section of a conical reentry space vehicle shown in FIGS. 1–3, inclusive, the method comprises essentially one step which, in part, has already been inferentially set out above.

More specifically, the method comprises the step of forming a reflecting base step, such as 14, having a base step angle, such as $\phi$, of a magnitude of 90 degrees, with the base step angle bounded by (i.e., formed by, and at) the intersection of the internal surface 11B of the heatshield 10 and the surface 13A of the base portion 13 of the heatshield 11, and wherein the dielectric constant of the dielectric heatshield 11 is in a range of values predetermined by the use of the equation:

$$\epsilon \geqq 2\,(1+\tan\alpha)+\tan^2\alpha$$

where $\epsilon$=dielectric constant of the heatshield and, $\alpha$=half angle cone of the conical reentry vehicle, such as 10.

PRINCIPLES OF OPERATION

A conical reentry space vehicle, or decoy thereof, that is designed with a low-loss heatshield will, when illuminated, support a dielectric mode within, or on, the air-dielectric boundary. By choice of dielectric thickness, dielectric constant, and dielectric shape near the rear, or base, of the reentry vehicle, the forward RCS of the reentry vehicle may be increased to values: which are in excess of the specular return from a metal reflector of diameter equal to the cone base of the reentry vehicle; and, which are 10 to 20 dB in excess of those from a metal cone of equal base diameter.

If the two conditions $$\epsilon \geqq 2\,(1+\tan\alpha)+\tan^2\alpha$$

and $\phi=90°$ are met, the contours of the reflecting base step 14 are defined, and relate the geometry of the reentry vehicle 10 (or of a decoy thereof) to the dielectric property.

Together these two conditions guarantee that complete internal reflection of an impinging illuminating (i.e., radar) signal will occur at the rear (i.e., the base 13) termination for forward aspect angles, such as $\alpha$.

CONCLUSION

It is abundantly clear from all of the foregoing, and from the Figures of the drawings, that the stated and desired objects, and other related objects, of my invention have been achieved.

While there have been shown and described the fundamental features of my invention, as applied to a preferred embodiment and as set forth in an inventive method, it is to be understood that various substitutions, omissions, adaptations, and the like may be made by those of ordinary skill in the art without departing from the spirit of the invention.

What is claimed is:

1. In a conical reentry vehicle having a geometric axis, a half cone angle, and a dielectric heatshield with an external surface, an internal surface, a forward portion with a nose, and a base portion with a surface, wherein the reentry vehicle has a radar cross section and the dielectric heatshield has a predetermined dielectric constant, the improvement comprising a reflecting step at the base portion of the heatshield, with the reflecting base step having a base step angle formed by, and at, the intersection of the internal surface of the heatshield and the surface of the base portion of the heatshield, and with the reflecting base step shaped to produce two total double reflections, internal of the heatshield, of any incident radar signal impinging in a nose-on attitude and direction upon the external surface of the heatshield and entering the heatshield, whereby the double reflected signal is re-directed outward from, and emerges outward of, the heatshield in the direction of the nose of the reentry vehicle, thereby increasing the nose-on radar cross section of the reentry vehicle.

2. The improvement, as set forth in claim 1, wherein the base step angle is 90 degrees and the dielectric constant of the dielectric heatshield is in a range of values predetermined by use of the equation:

$$\epsilon \geqq 2\,(1+\tan\alpha)+\tan^2\alpha$$

where $\epsilon$=dielectric constant of the heatshield and, $\epsilon$=half angle cone of the conical reentry vehicle.

3. The method of augmenting a radar cross section of a conical reentry space vehicle having a radar cross section, a geometric axis, a half cone angle, and a dielectric heatshield having a dielectric constant, a forward portion with a nose, an external surface, an internal surface, and a base portion with a surface, comprising the step of forming a reflecting base step having a base step angle of a magnitude of 90 degrees, wherein said base step angle is formed by, and at, the intersection of the internal surface of the heatshield and the surface of the base portion of the heatshield, and wherein the dielectric constant of the heatshield is in a range of values predetermined by the use of the equation:

$$\epsilon \geqq 2\,(1+\tan\alpha)+\tan^2\alpha$$

where $\epsilon$=dielectric constant of the heatshield and, $\alpha$=half angle cone of the conical reentry vehicle.

* * * * *